US005669607A

United States Patent [19]

Silver et al.

[11] Patent Number: 5,669,607

[45] Date of Patent: Sep. 23, 1997

[54] CASH REGISTER GAME OF SKILL

[75] Inventors: Thomas L. Silver; David Wise, both of Dayton Beach, Fla.

[73] Assignee: Bob's Space Racer's Inc., Daytona Beach, Fla.

[21] Appl. No.: 742,585

[22] Filed: Oct. 28, 1996

[51] Int. Cl.[6] ..... A63F 9/02

[52] U.S. Cl. ..... 273/354; 273/356; 273/369

[58] Field of Search ..... 273/354–356, 273/366, 369, 454

[56] References Cited

U.S. PATENT DOCUMENTS

| | | | |
|---|---|---|---|
| 1,563,983 | 12/1925 | Higuchi . | |
| 1,640,954 | 8/1927 | Mach . | |
| 2,017,048 | 10/1935 | Hoke, Jr. | 273/356 |
| 2,534,730 | 12/1950 | Peacock | 273/345 X |
| 3,787,052 | 1/1974 | Glass et al. . | |
| 4,123,059 | 10/1978 | Guibas . | |
| 4,184,680 | 1/1980 | Gage . | |
| 4,496,160 | 1/1985 | Wichinsky et al. . | |
| 4,759,551 | 7/1988 | Crompton | 273/366 X |
| 5,150,898 | 9/1992 | Hochberg et al. | 273/369 X |
| 5,501,466 | 3/1996 | Welch et al. . | |
| 5,511,794 | 4/1996 | Katamoto | 273/454 X |
| 5,595,387 | 1/1997 | Senna | 273/369 |

FOREIGN PATENT DOCUMENTS

| | | | |
|---|---|---|---|
| 634867 | 2/1962 | Italy | 273/354 |

*Primary Examiner*—Paul E. Shapiro

*Attorney, Agent, or Firm*—Larson & Larson, P.A; James E. Larson

[57] ABSTRACT

A game of skill involves a housing made to resemble an old-style cash register. When the game is played, a motor causes oscillation of the cash drawer in and out while the player shoots coin-like disks toward the drawer attempting to land the coins within compartments within the drawer. Each compartment corresponds to a point score that is displayed on a display on the simulated cash register. Each time the game is played, the player is given a pre-set number of coin-like disks.

20 Claims, 9 Drawing Sheets

CASH REGISTER GAME OF SKILL

BACKGROUND OF THE INVENTION

1. Field of Invention

The present invention relates to a game of skill. More particularly, it relates to a coin projecting cash register game.

2. Background of the Prior Art

In the prior art, games of skill are known. However, Applicant is unaware of any such game including all of the features and aspects of the present invention. The following prior art is known to Applicant:

U.S. Pat. No. 1,563,983 to Higuchi

U.S. Pat. No. 1,640,954 to Mach

U.S. Pat. No. 3,787,052 to Glass et al.

U.S. Pat. No. 4,123,059 to Guibas

U.S. Pat. No. 4,184,680 to Gage

U.S. Pat. No. 4,496,160 to Wichinsky et al.

U.S. Pat. No. 5,501,466 to Welch et al.

The present invention distinguishes from the teachings of these patents, taken alone or in combination with one another, as contemplating a simulated cash register having a cash drawer that is made to continually oscillate between open and closed positions and whereby a user may shoot coin-like disks, attempting to land them in various compartments within the cash drawer which compartments appear and disappear.

SUMMARY OF THE INVENTION

The present invention relates to a cash register game. The present invention includes the following interrelated objects, aspects and features:

(1) In a first aspect, the inventive game includes a base, preferably made up of two supports that, together, support a game housing. The game housing includes a rear portion that is made to resemble an old-style cash register having a cash drawer, a display and an arcuate portion between the cash drawer and the display having a plurality of simulated buttons.

(2) The cash drawer has an actuator including an electric motor with a shaft coupled to a disk with an actuating rod eccentrically mounted thereon so that rotations of the motor shaft result in reciprocations of the cash drawer between open and closed positions. While the game is being played, the motor continuously operates so that the cash drawer is continuously opening and closing. The cash drawer has a plurality of compartments therein, each one of which provides a target.

(3) The game housing also includes a front portion at which is mounted a projectile mechanism that preferably includes a solenoid actuated plunger that, when actuated, may project a coin-like disk toward the oscillating cash drawer. An actuating button is located on the front portion for use by a player.

(4) A check control mechanism is employed to receive coins and/or bills from the player who wishes to play the game. Within the game housing and, if desired, extending into one of the two supports, a mechanism is provided to store the coin-like disks and to provide a selected number of such coins to the player when the correct amount of money has been tendered by the check control mechanism.

(5) In the preferred embodiment, the compartments of the cash drawer are assigned a point value and the object of the game is to project as many coin-like disks as possible into the compartments of the cash drawer. Upon each oscillation of the cash drawer, a random sequence chooses one of the compartments as a bonus award value. Upon depositing a projected coin in the bonus compartment, a bonus award is given. The score obtained through projecting of coins toward the cash drawer is continually shown on the display of the simulated cash register for viewing by the player and other viewers.

As such, it is a first object of the present invention to provide a cash register game.

It is a further object of the present invention to provide such a game with a simulated cash register having a drawer that continually oscillates during the playing of the game.

It is a still further object of the present invention to provide such a game wherein a projectile mechanism is provided to project coin-like disks toward the oscillating cash drawer.

It is a still further object of the present invention to provide such a game wherein a display on the simulated cash register displays the scoring attained through projecting of coin-like disks into compartments in the cash drawer.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
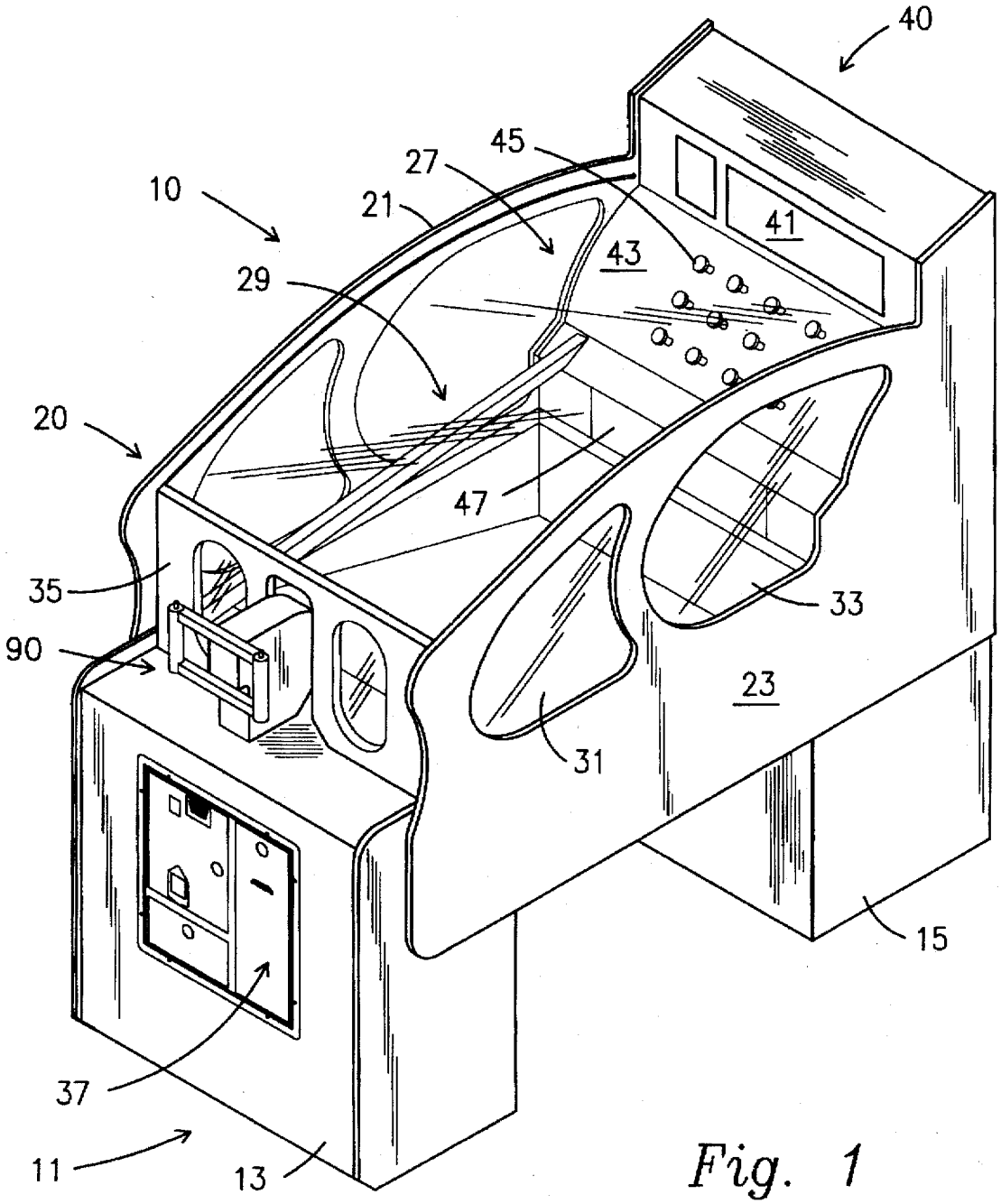
FIG. 1 shows a perspective view of the present invention.
Figure 2:
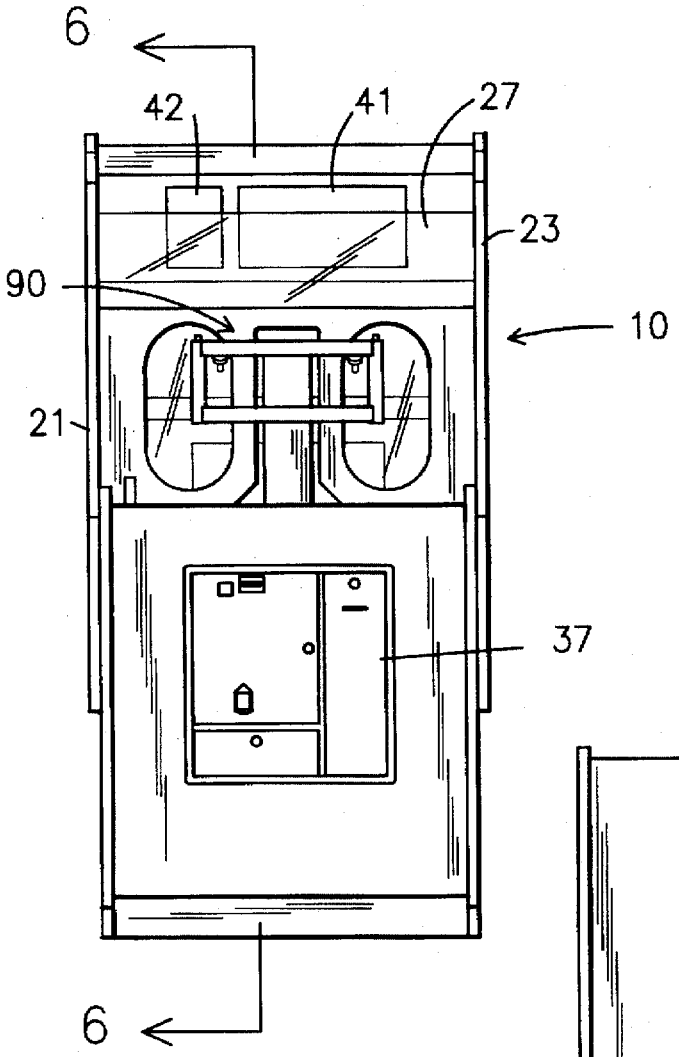
FIG. 2 shows a front view of the present invention.
Figure 3:
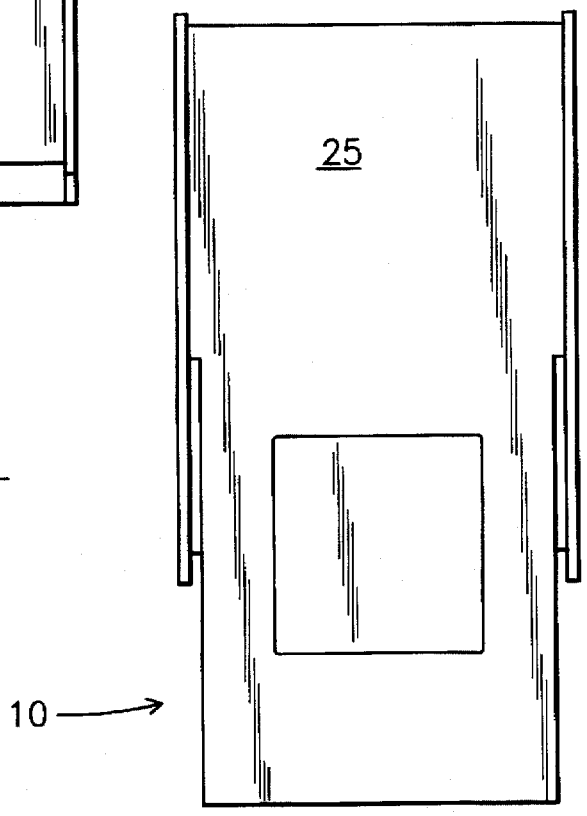
FIG. 3 shows a rear view of the present invention.
Figure 4:
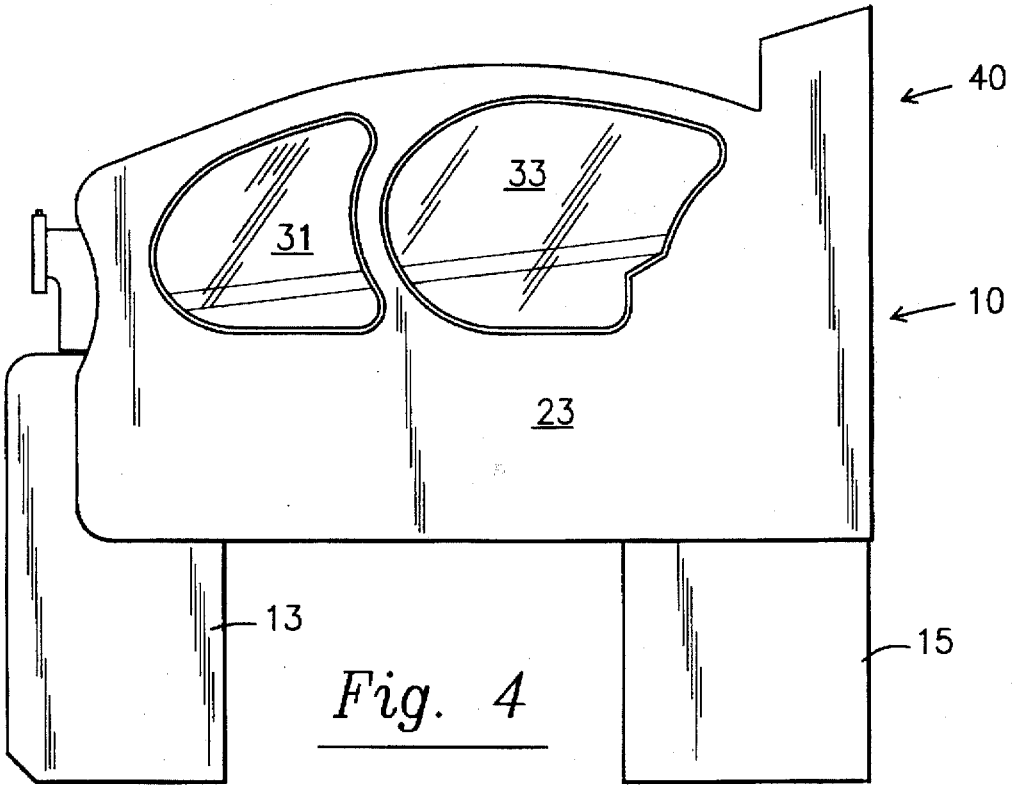
FIG. 4 shows a right side view of the present invention.

With reference, first, to FIG. 1, the inventive game is generally designated by the reference numeral 10 and is seen to include a base 11 made up of a front support 13 and a rear support 15. A game housing 20 sits on top of the supports 13 and 15 and includes side walls 21 and 23 as well as a rear wall 25 (FIG. 3) and a top wall 27 made of a transparent material such as that which is sold under the Trademark "PLEXIGLAS". The side walls 21 and 23 also have transparent windows therein to permit viewing an internal chamber 29 within the game housing 20 laterally. For example, the side wall 23 includes transparent windows 31 and 33. As seen in FIG. 1, the side wall 21 has similar windows. The game housing 20 also has a front wall 35.

The front support 13 includes a check control mechanism 37 designed to receive coins (and/or bills, if desired) and includes an internal mechanism (not shown) designed to verify the authenticity of coins placed therein. If desired, and as is well known in the prior art, the check control mechanism 37 may also return change to the user. The front support 13 may also include a compartment within its interior designed to provide storage for coins placed therein for later collection.

Figure 5:
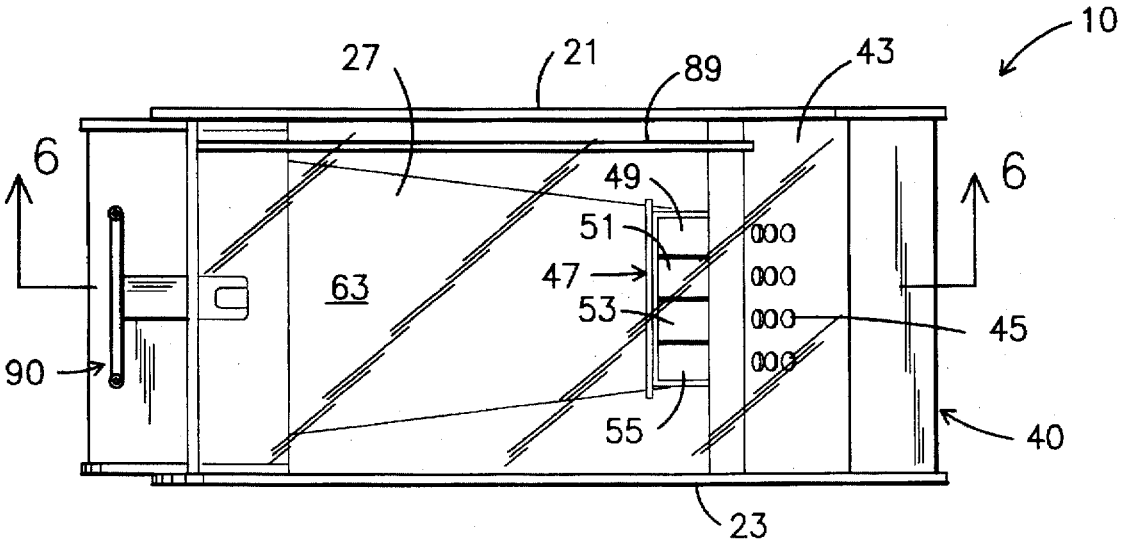
FIG. 5 shows a top plan view of the present invention.
Figure 6:
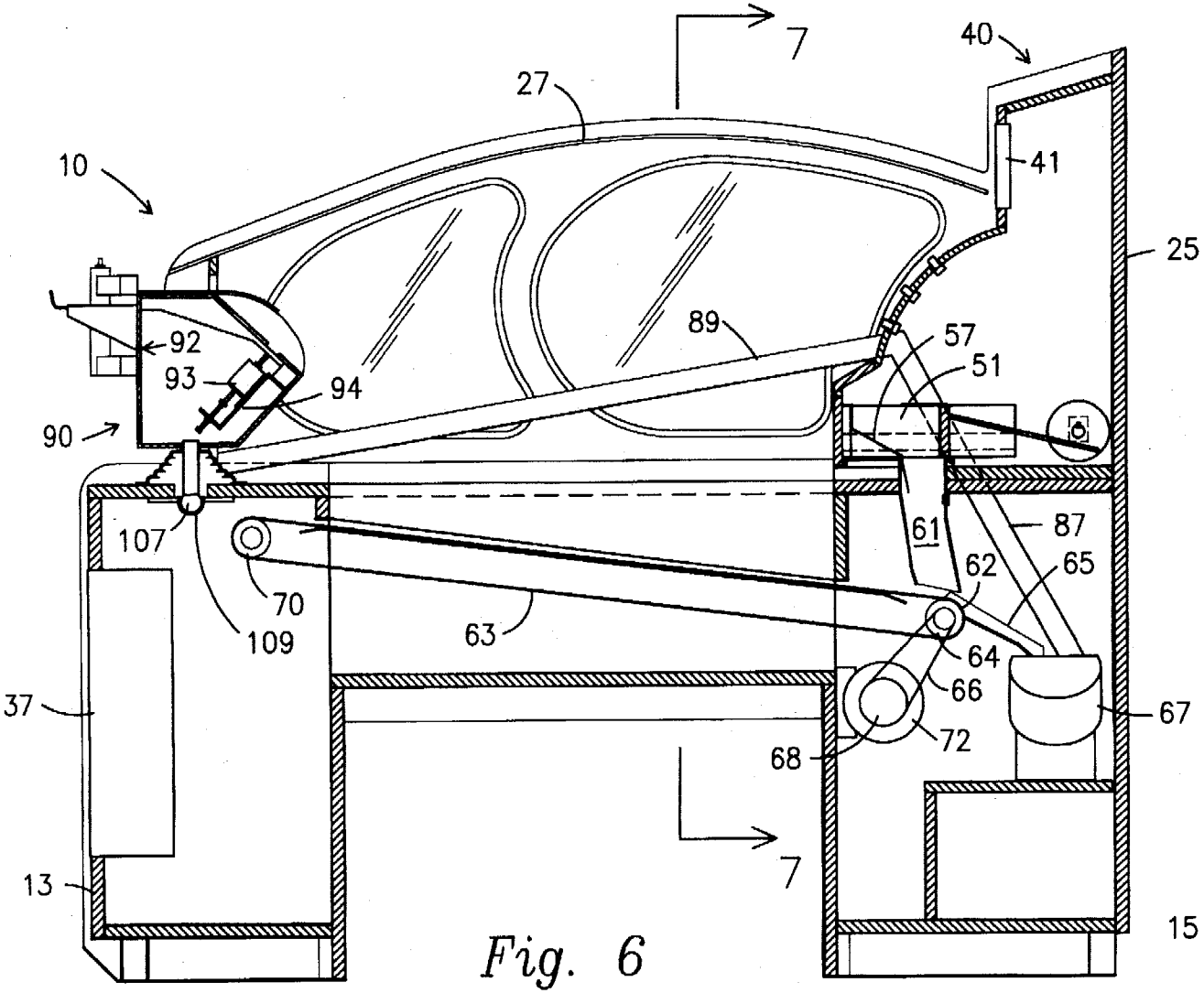
FIG. 6 shows a cross-sectional view along the line 6—6 of FIG. 2.
Figure 9:
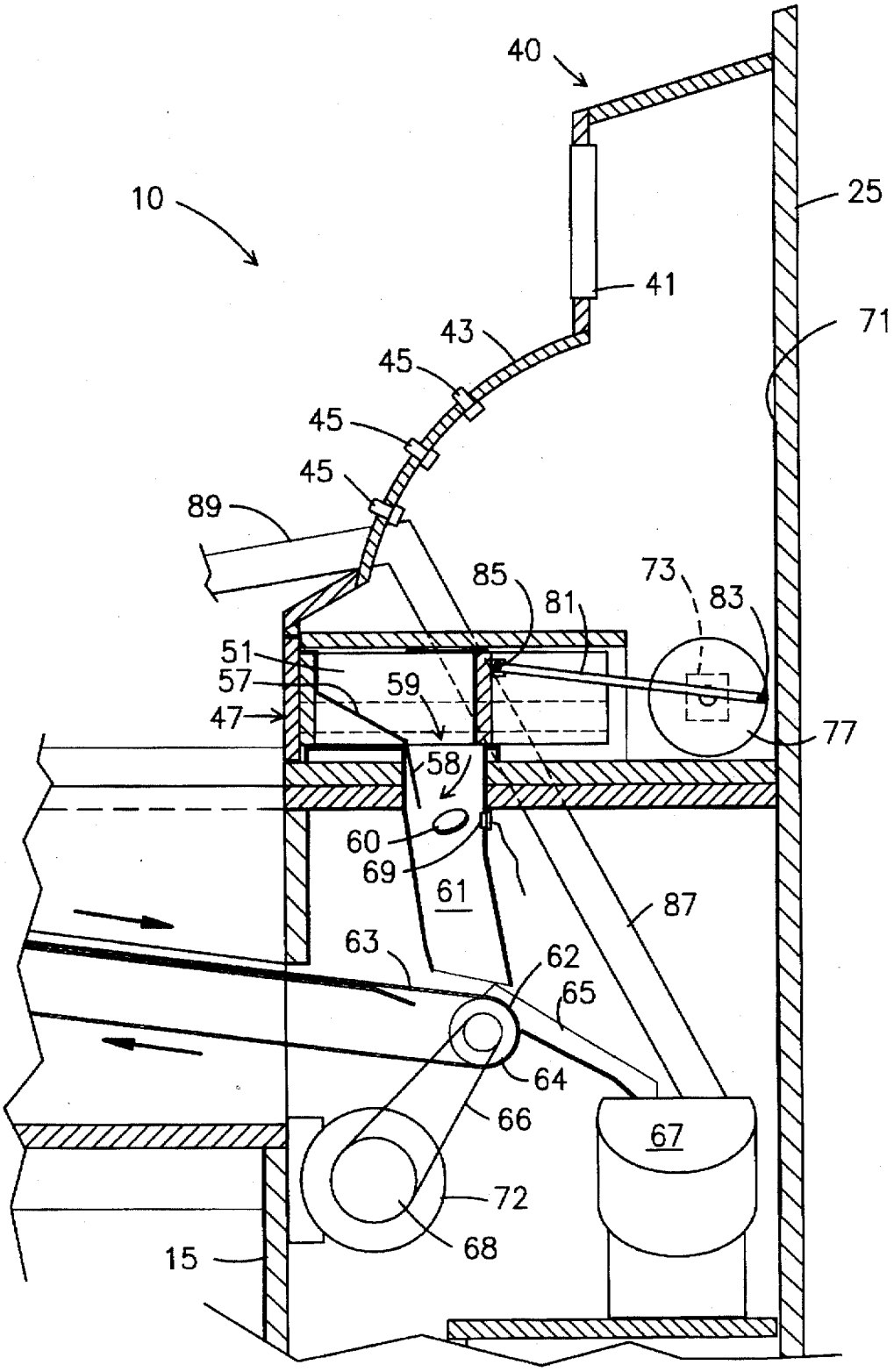
FIG. 9 shows an enlarged cross-sectional view of another portion of the cross-section of FIG. 6, with the cash drawer in the closed position.
Figure 10:
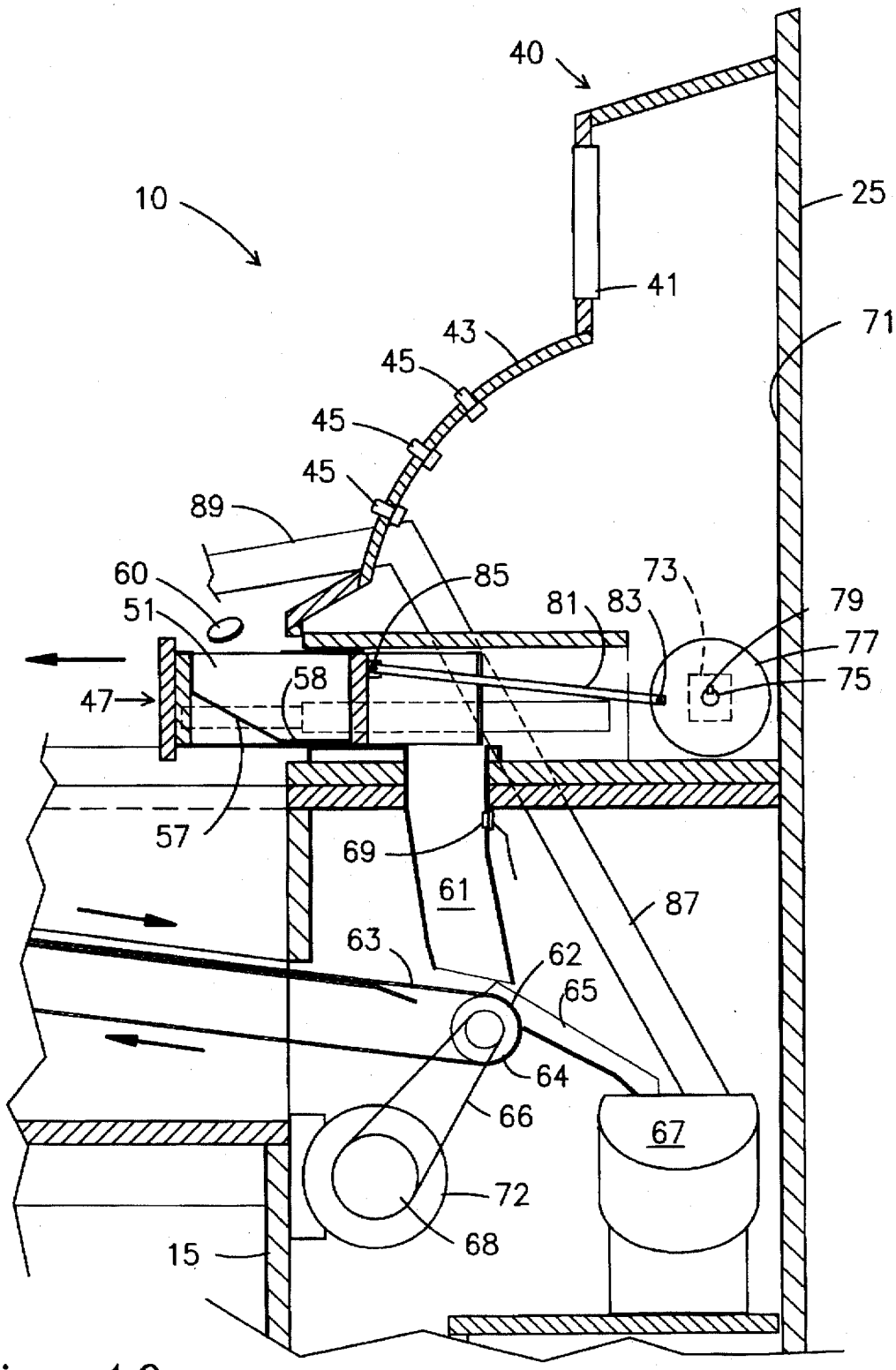
FIG. 10 shows a view similar to that of FIG. 9 but with the cash drawer in the open position.

As seen in FIG. 1, the game housing 20 includes a rear portion 40 that is made to resemble an old-style cash register. As seen in FIG. 1, the simulated cash register includes a display area 41, an arcuate surface 43 having a multiplicity lights 45 disposed in a vertical column-like formation simulating buttons of the cash register, and a cash drawer 47 of which the front portion thereof is seen in FIG. 1. With reference to FIG. 5, it is seen that the cash drawer 47 has a plurality of compartments 49, 51, 53 and 55 separated by dividers as shown. As seen in FIG. 5, each compartment corresponds to a single vertical column of lights. FIGS. 6, 9 and 10 particularly show the compartment 51 that is typical of the compartments employed in the cash drawer 47. As seen in FIG. 9, the compartment 51 includes a ramp surface 57 leading to a bottom opening 59 leading to a first chute 61 that leads to a conveyor belt 63 feeding coins 60 to a second chute 65 and thence to a hopper 67. The conveyor belt 63 is driven by a first pulley 64, a belt 66, a second pulley 68 and a motor 72 rotating the second pulley 68. A third pulley 70 (FIG. 6), disposed at an opposite end from first pulley 64, allows conveyor belt 63 to continuously rotate.

Further seen in FIG. 9, a photoelectric cell 69 sends a beam of light across first chute 61 that reflects back to the cell 69. When a coin 60 passes through the beam of light, a signal is sent to a controller mechanism of the inventive game 10 so that a score may be registered on the display 41. In the preferred embodiment, the score is tallied and displayed to simulate dollar values.

With reference now to FIGS. 9 and 10, it is seen that when the cash drawer 47 is in the open position as seen in FIG. 10, a gate 58 combines with the ramp 57 to enclose the bottom of the drawer 47. When the cash drawer 47 is in the closed position as seen in FIG. 9, the gate 58 enters the opening 59 to help guide any coins 60 that have fallen within the compartment 51 to first chute 61.

With further reference to FIGS. 9 and 10, it is seen that the simulated cash register 40 has an internal compartment 71 in which is mounted oscillating means including a motor 73 shown in phantom in FIGS. 9 and 10. The motor 73 has a drive shaft 75 to which is mounted an enlarged disk 77 that is constrained to rotate with the shaft 75 through the use of a key 79. The oscillating means further includes an elongated rod 81 pivotably mounted to the disk 77 at the pivot 83 and pivotally mounted to the rear of the cash drawer 47 at the pivot 85. As should be understood, as the shaft 75 rotates the disk 77, with reference to FIG. 9, when the pivot 83 is in the position shown therein, the cash drawer 47 is in the closed position. When the shaft 75 has rotated the disk 77 by 180 degrees, the pivot 83 assumes the position shown in FIG. 10 with the cash drawer 47 in the open position. As should be understood, as the shaft 75 is rotated, the cash drawer 47 continually oscillates between the open and closed positions seen in FIGS. 10 and 9, respectively. If desired, a gearing mechanism may be interposed between the shaft 75 and the disk 77 so that the speed of rotation of the disk 77 and, thereby, the speed of oscillation of the cash drawer 47 may be suitably adjusted. Alternatively, the motor 77 may be controlled by a rheostat to control the speed of rotation thereof.

Figure 7:
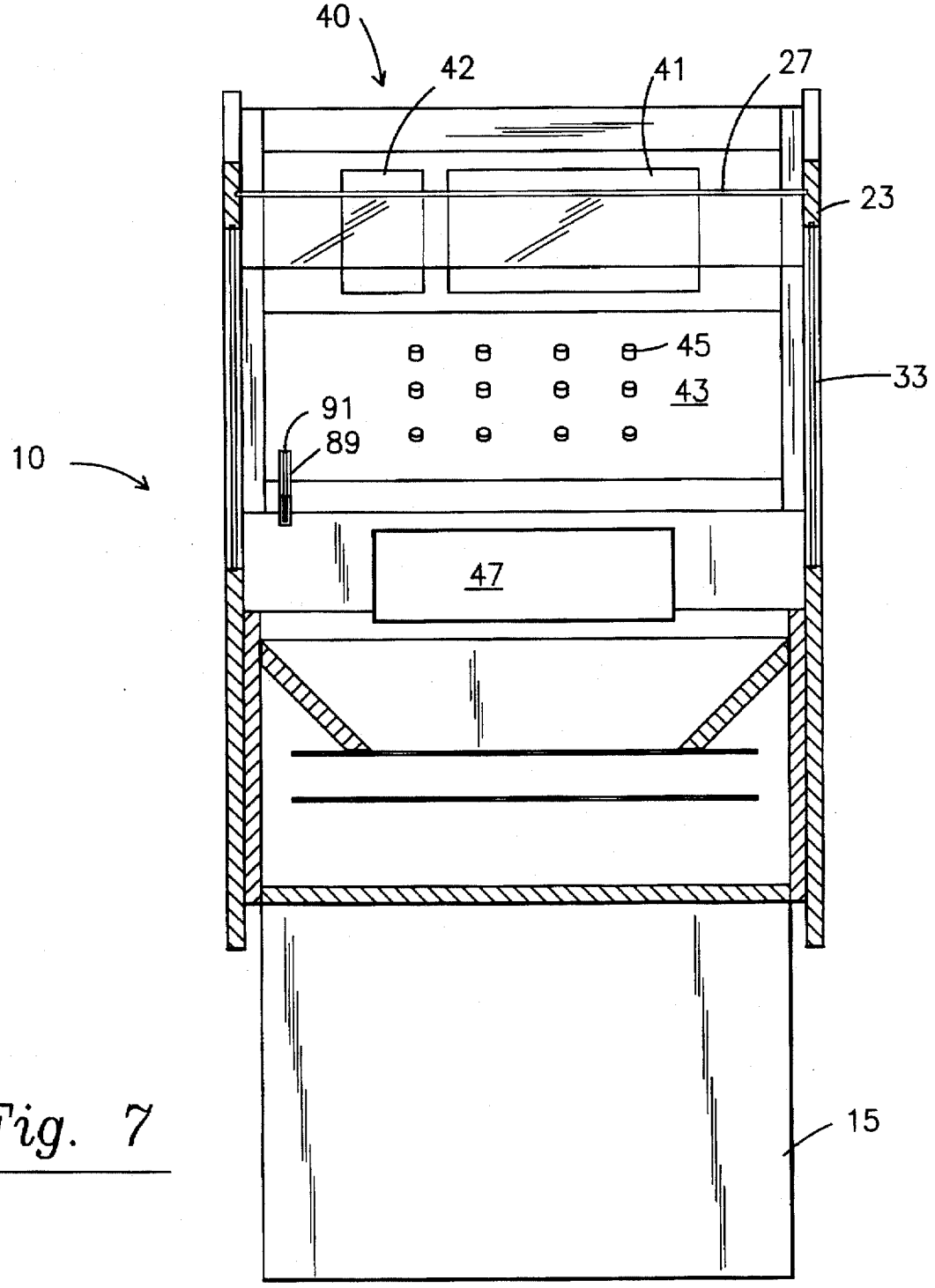
FIG. 7 shows a cross-sectional view along the line 7—7 of FIG. 6.

With reference to FIGS. 6, 9 and 10, in particular, it is seen that the hopper 67 has a coin return ramp 87 that lifts coins 60 from hopper 67, contained therein, up to a ramp 89 having a slot 91 therein (FIG. 7) allowing the coins 60 to roll by the force of gravity to a forward portion of the game housing 20. The player is then permitted to pickup up coins 60 and selectively insert them into a projectile mechanism, to be described immediately hereinafter.

Figure 8:
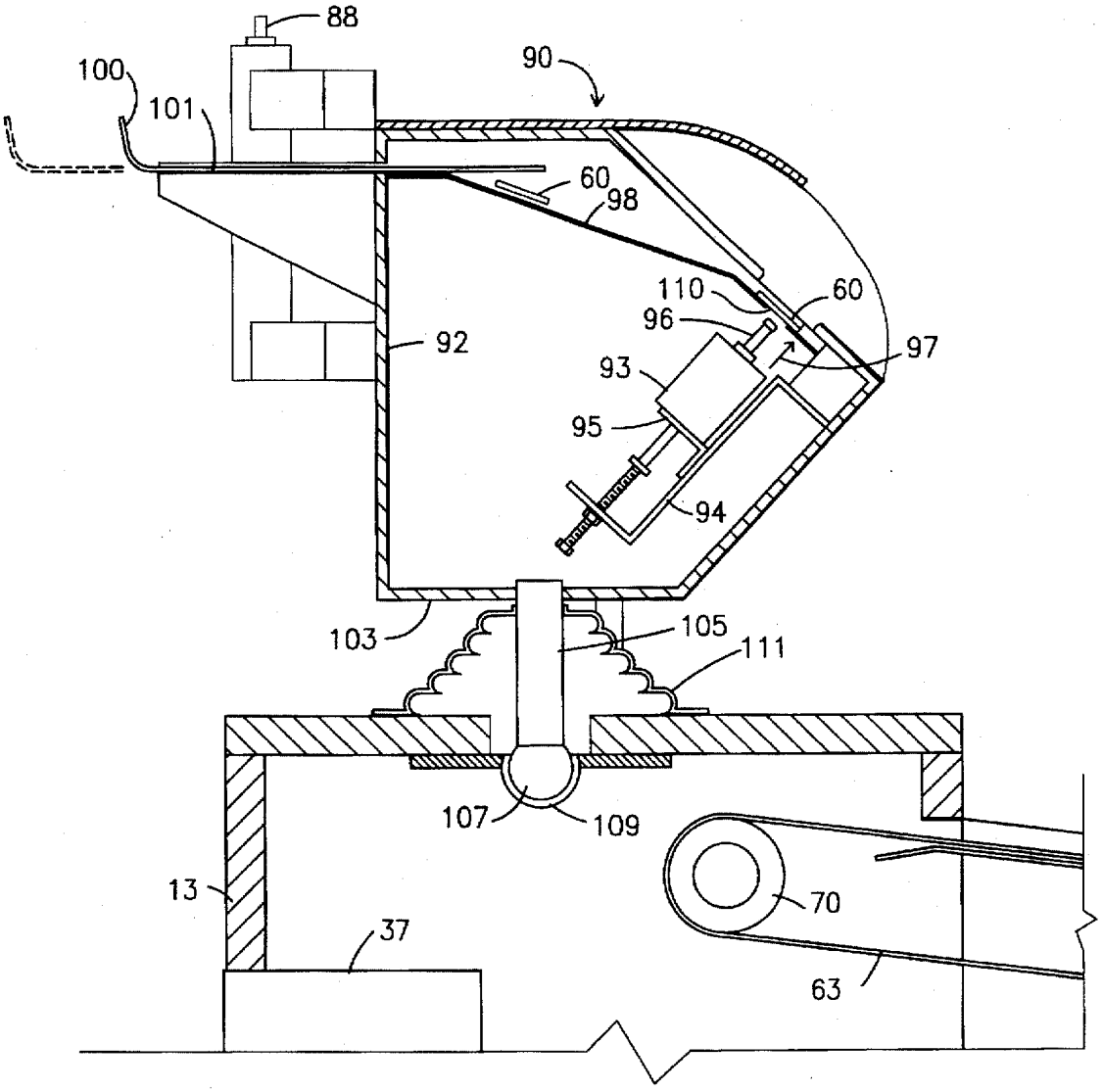
FIG. 8 shows a portion of the cross-sectional view of FIG. 6 but enlarged to show detail.

With reference, now, to FIGS. 6 and 8, a projectile mechanism is generally designated by the reference numeral 90 and is seen to include an internal chamber 92 in which is contained a solenoid 93 mounted on a bracket 94 through the use of an additional bracket 95 (FIG. 8). With reference to FIG. 8, the solenoid 93 has a plunger 96 that, when the coil of the solenoid 93 is energized, reciprocates sharply in the direction of the arrow 97 to project through an opening 110 formed in a coin loading ramp 98 and strike the coin 60, thereby projecting the coin 60 toward the simulated cash register 40. Actuating means comprising an actuator button 88 is mounted on the projectile mechanism 90 and, when depressed, activates the solenoid 93 to cause movement of the plunger 96 in the direction of the arrow 97 to project the coin 60 toward the cash register 40. When the solenoid 93 is deactivated, the plunger 96 is restored to the position shown in FIG. 8.

With further reference to FIG. 8, a slide mechanism 100 is slidably mounted on the projectile mechanism 90 and includes a recess (not shown) aligned with an opening in the structure 101 adjacent thereto (not shown) when the slide 100 is in the phantom position shown in FIG. 8. When the slide 100 is pushed inwardly to the solid line position shown in FIG. 8, the coin 60 is dispensed onto the ramp 98 and falls through the force of gravity to the position shown in FIG. 8. Thereafter, activation of the solenoid 93 causes the plunger 96 thereof to reciprocate sharply toward the coin 60 to project the coin 60 toward the simulated cash register 40 within the chamber 29.

As shown in particular in FIG. 8, the projectile mechanism 90 includes a bottom wall 103 on which is mounted a stem 105 having a distal spherical end or ball 107 received within a spherical socket 109 mounted on the top of the front support 13 (FIG. 6). A bellows 111 seals between the front support 13 and the periphery of the stem 105 to prevent contamination. The ball 107 and the socket 109 are mounted together with frictional interengagement that causes the projectile mechanism 90 to maintain itself in any position at which the user has placed it. Interactions between the ball 107 and the socket 109 permit the player to aim the plunger 96 at any desired direction within the limits of the pivoting engagement. In particular, a player can pivot the projectile mechanism 90 about three axes. The limits of projectile mechanism 90 prohibit a player from firing coin 60 so as to strike top wall 27 of inventive game 10.

Figure 11:
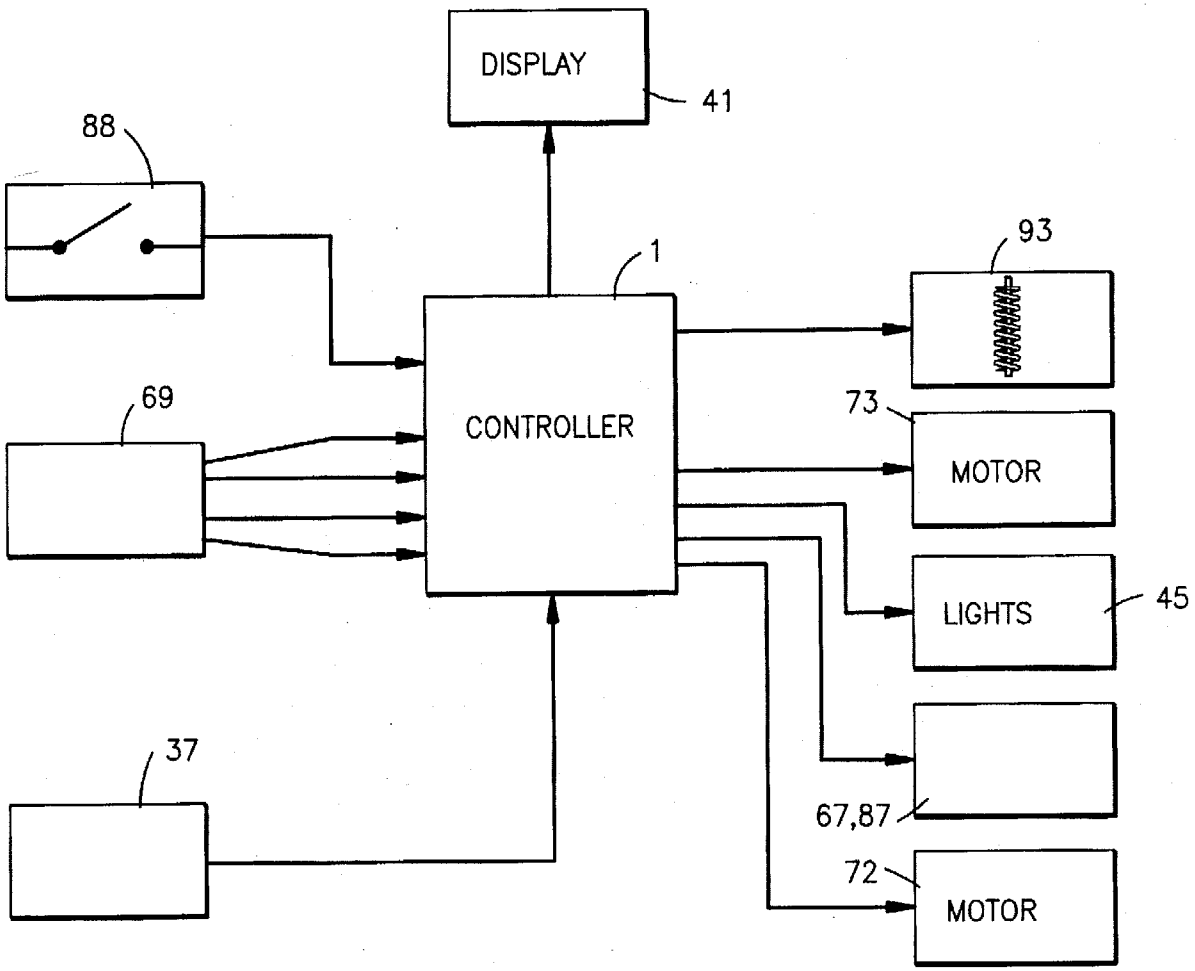
FIG. 11 shows a schematic representation of the electrical circuitry of the present invention.

FIG. 11 shows a schematic representation of the electrical circuitry of the present invention. As shown in FIG. 11, the controller 1 may be a microcomputer or other similar device. When money is received by the check control mechanism 37 and is verified as true coinage, a signal is sent to the controller 1 so that the system may be activated. The system including the hopper 67 and ramp 87 is activated by the controller 1 to move coins 60 from hopper 67 up ramp 87 to provide the user with a pre-set number of coins 60. These coins roll down the slot 91 of the ramp 89 (FIG. 7) and to a location at the front of the device 10 where they may be retrieved by the user either one at a time or all together. This permits the player to actively communicate with the coin prior to firing. In this respect, game 10 is different from much of the prior art which never allows the player to communicate with the projectiles. Accordingly, the player can pace themselves by deciding when to insert and project one of the coins 60. Game 10 can be provided with a inactivity timer (not shown) which will terminate a given game if the system establishes that play has become inactive (for example, the player decides to keep the coins as souvenirs and walks away from game 10).

One by one, coins 60 are inserted in the slide mechanism 100 and are dispensed down the ramp 98 to the position shown in FIG. 8 where they are aligned with the plunger 96 of the solenoid 93. With particular reference to FIG. 8, the housing of the projectile mechanism 90 is moved through movements of the ball 107 with respect to the socket 109 to aim the plunger 96 in a desired direction. Thereafter, the button 88 is pushed thereby closing a switch and causing the controller 1 to activate the solenoid 93 thereby causing a sharp substantially instantaneous movement of the plunger 96 in the direction of the arrow 97 (FIG. 8) to cause the coin 60 to be projected toward the simulated cash register 40.

In the meantime, when the controller 1 has received the signal from the check control mechanism 37, the motor 73 is activated causing rotations of the disk 77 to thereby cause oscillations of the cash drawer 47 between the positions shown in FIGS. 9 and 10. In addition, each time cash drawer 47 closes, a different vertical column of lights 45 is chosen to establish the corresponding bonus value compartment. The choice is made by the controller 1 using a random look up table (not shown) having a set number of positions. In the preferred embodiment a 32 bit table is used. The user tries to time the moment of depression of the button 88 to coincide with a time where the cash drawer 47 will be open when the coin 60 arrives there. If the coin 60 arrives when the cash drawer 47 is closed as shown by the position of the cash drawer in FIG. 9, the coin 60 will fall onto the conveyor 63 and will be conveyed to the ramp 65 whereupon it enters the hopper 67. If, alternatively, the coin 60 arrives, as shown in FIG. 10, when the cash drawer 47 is open, the coin 60 will enter one of the compartments of the cash drawer 47 so that when the cash drawer 47 subsequently closes, the coin 60 will fall into the chute 61, passing the photoelectric eye 69 contained therein. Each compartment 49, 51, 53 and 55 of the cash drawer 47 has a ramp 61 aligned therewith and a separate photoelectric eye 69 aligned therewith to record the passage of a coin 60 therepast. With reference back to FIG. 11, each photoelectric eye 69 is separately connected to the controller 1 so that signals may be conveyed to the controller 1 indicative of which compartment of the compartments 49, 51, 53 and 55 has received the coin 60. The controller 1 is preprogrammed so that when it receives signals from one of the photoelectric eyes 69, it is able to determine which compartment 49, 51, 53 or 55 has received the coin 60. The controller 1 is preprogrammed to award a score to each of the compartments whereby the score achieved is displayed on the display 41. Such score is maintained cumulatively during the playing of the game and is increased with each successful projection of a coin 60.

In the preferred embodiment, when a player pays the required fee, the player is given five coins 60 via the slot 91 in the ramp 89. The game ends when the player has projected five coins toward the drawer 47. Alternatively, if desired, the present invention may also employ a timer so that the player must project the desired number of coins within a prescribed time period. An additional display 42 (FIG. 7) may also be provided to provide the time display, if desired.

While the game is being played, the controller 1 is operative to cause lights contained within the simulated buttons 45 to illuminate in various patterns as desired. In the preferred embodiment the controller 1 is preprogrammed to cause activation of illumination means within the simulated buttons 45 corresponding to and aligned with one of the compartments in the cash drawer 47. Thus, for example, if the three simulated buttons 45 aligned with a particular compartment of the cash drawer 47 are illuminated when a coin 60 successfully enters that compartment and passes by the corresponding photoelectric eye 69, a bonus score is achieved. Scoring may be displayed as dollar values or using any other standard of measurement. Additionally, the inventive game 10 may be provided with a source of music.

As such, an invention has been disclosed in terms of a preferred embodiment thereof which fulfills each and everyone of the objects of the invention as set forth hereinabove and provides a new and useful cash register game of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims and all equivalent thereof.

We claim:

1. A game of skill, comprising:

a) a housing having a front wall, a rear wall and a top transparent wall extending therebetween, the front, rear and top walls defining a chamber, b) a target adjacent the rear wall and including a plurality of compartments, the target comprising a drawer, the rear wall including an opening formed therein for slidably receiving the drawer, c) oscillation means for oscillating the target between a first position wherein the compartments are closed and a second position wherein the compartments are open, d) a projectile mechanism adjacent the front wall and selectively operable to project a projectile toward the target, the projectile mechanism comprising a solenoid with a plunger, the plunger extending when the solenoid is activated to strike a projectile and project it toward the target, e) actuating means for actuating the projectile mechanism, and f) control means for controlling the oscillation means and activating the game.

2. The game of claim 1, further comprising a pair of side walls between the front and rear walls.

3. The game of claim 2, wherein the pair of side walls each have transparent portions.

4. The gave of claim 1, wherein the rear wall resembles a cash register having an arcuate portion along a top portion of the cash register.

5. The game of claim 4, wherein the drawer resembles a cash drawer of the cash register and is positioned below the arcuate portion.

6. The game of claim 4, wherein the cash register includes a plurality of simulated buttons disposed along the arcuate portion in vertical columns, the simulated buttons having illumination means contained therewithin.

7. The game of claim 6, wherein there are four compartments and four vertical columns of simulated buttons, one of each of the four columns of simulated buttons disposed directly above one of each of the four compartments, the control means controlling the illumination means contained within the simulated buttons.

8. The game of claim 1, wherein the oscillation means comprises a motor with a rotary shaft, a rod eccentrically mounted on the shaft at one end thereof and having a second end coupled to the drawer, whereby rotation of the shaft causes oscillation of the rod and thereby of the drawer, the motor directly responsive to the control means such that the motor is activated upon the control means activating the game.

9. The game of claim 1, wherein each of the plurality of compartments includes a floor having a pivotable gate, the gate being closed in the compartment second position and open in the compartment first position.

10. The game of claim 9, wherein the housing has a chute mounted under each of the plurality of compartments, each chute having means for detecting passage of a projectile therethrough.

11. The game of claim 10, wherein the means for detecting passage of a projectile therethrough is a photoelectric cell.

12. The game of claim 1, wherein the actuating means comprise a switch controlled by a button.

13. A game of skill, comprising:

a) a housing having a front wall, a rear wall and a top transparent wall extending therebetween, the front, rear and top walls defining a chamber, the rear wall resembling a cash register, b) a target adjacent the rear wall and including a plurality of compartments, the target comprising a drawer and resembling a cash drawer of the cash register, the rear wall including an opening formed therein for slidably receiving the drawer, c) oscillation means for oscillating the target between a first position wherein the plurality of compartments are closed and a second position wherein the plurality compartments are open, d) each of the plurality of compartments including a floor having a pivotable gate, the gate being closed in the second position and open in the first position, e) a chute mounted under each of the plurality of compartments, each chute having means for detecting passage of a projectile therethrough, f) a projectile mechanism adjacent the front wall and selectively operable to project a projectile toward the target, the projectile mechanism comprising a solenoid with a plunger, the plunger extending when the solenoid is activated to strike a projectile and project it toward the target, g) actuating means for actuating the projectile mechanism, and h) control means for controlling the oscillation means and for activating and maintaining the game.

14. The game of claim 13, further comprising a pair of opposed side walls positioned between the front and rear walls, each side wall having at least one transparent portion.

15. The game of claim 13, wherein the cash register has an arcuate portion along a top end of the cash register, a display and a plurality of simulated buttons disposed along the arcuate portion in vertical columns, the simulated buttons having illumination means contained therewithin.

16. The game of claim 15, wherein the means for detecting passage of a projectile through the chute is a photoelectric cell, the photoelectric cell sending a signal to the control means when the cell has detected the passage of a projectile, the control means capable of determining a point value due to the passage thereby and additionally capable of displaying and continuously updating a game score on the display.

17. The game of claim 15, wherein there are four compartments and four vertical columns of lights, one of each of the four columns of lights disposed directly above one of each of the four compartments, the control means controlling the illumination means contained within the simulated buttons.

18. The game of claim 13, wherein the oscillation means comprises a motor with a rotary shaft, a rod eccentrically mounted on the shaft at one end thereof and having a second end coupled to the drawer, whereby rotation of the shaft causes oscillation of the rod and thereby of the drawer, the motor directly responsive to the control means such that the motor is activated upon the control means activating the game.

19. A game of skill, comprising:

a) a housing having opposed front wall and rear walls, a top transparent wall extending therebetween and opposed side walls positioned between the front and rear walls, the front, rear, top and side walls defining a chamber, the rear wall resembling a cash register, b) the cash register having an arcuate portion along a top end of the cash register, a display and a plurality of simulated buttons disposed along the arcuate portion in vertical columns, the simulated buttons having illumination means contained therewithin, c) a target adjacent the rear wall and including a plurality of compartments, the target comprising a drawer and resembling a cash drawer of the cash register, the rear wall including an opening for slidably receiving the drawer, the opening formed below the arcuate portion of the cash register, d) oscillation means for oscillating the target between a first position wherein the plurality of compartments are closed and a second position wherein the plurality compartments are open, e) each of the plurality of compartments including a floor having a pivotable gate, the gate being closed in the second position and open in the first position, f) a chute mounted under each of the plurality of compartments, each chute having means for detecting passage of a projectile therethrough, g) a projectile mechanism adjacent the front wall and selectively operable to project a projectile toward the target, the projectile mechanism comprising a solenoid with a plunger, the plunger extending when the solenoid is activated to strike a projectile and project it toward the target, h) actuating means for actuating the projectile mechanism, i) control means for controlling the oscillation means and for activating and maintaining the game, and j) projectile return means for depositing all projectiles employed in the game in a central location and for selectively providing projectiles to a player of the game.

20. The game of claim 19, wherein the projectile return means comprises a conveyor belt located in a lower portion of the housing chamber, a hopper located below the cash register, a first ramp communicating with the coin hopper and a second ramp communicating with the first ramp such that all projectiles employed in the game are deposited in the hopper and provided to the player by advancing a projectile up the first ramp from the hopper and permitting the projectile to roll by the force of gravity along a channel formed in the second ramp, the projectile advancement sequence initiated by the control means.

* * * * *